US006978610B2

(12) United States Patent
Carnahan

(10) Patent No.: US 6,978,610 B2
(45) Date of Patent: Dec. 27, 2005

(54) REVERSIBLE HEAT ENGINE

(76) Inventor: Eric Scott Carnahan, 2615 Carolyn Dr., Smyrna, GA (US) 30080

( * ) Notice: Subject to any disclaimer, the term of this patent is extended or adjusted under 35 U.S.C. 154(b) by 217 days.

(21) Appl. No.: 10/701,037

(22) Filed: Nov. 5, 2003

(65) Prior Publication Data

US 2005/0091974 A1 May 5, 2005

(51) Int. Cl.[7] ..... F03C 1/00
(52) U.S. Cl. ..... 60/495; 60/496; 60/645
(58) Field of Search ..... 60/645, 495, 496

(56) References Cited

U.S. PATENT DOCUMENTS 4,498,294 A * 2/1985 Everett ..... 60/496
4,718,232 A * 1/1988 Willmouth ..... 60/495
6,223,532 B1 * 5/2001 Brassea-Flores ..... 60/495
6,405,165 B1 * 6/2002 Blum et al. ..... 704/235

* cited by examiner

*Primary Examiner*—Hoang Nguyen

(57) ABSTRACT

A heat engine capable of significantly higher thermal efficiencies than existing heat engines operating within the same temperature ranges, wherein the heat engine can operate efficiently as either a forward heat engine or as a reverse heat engine at any given selected moment; thus, permitting the present heat engine to be utilized as an air conditioner or heat pump, or, alternatively, if a heat source is provided to the engine, as a forward heat engine producing a work output.

27 Claims, 5 Drawing Sheets

FIGURE 1 CARNOT CYCLE ENGINE WITH ELECTRICAL WORK OUTPUT
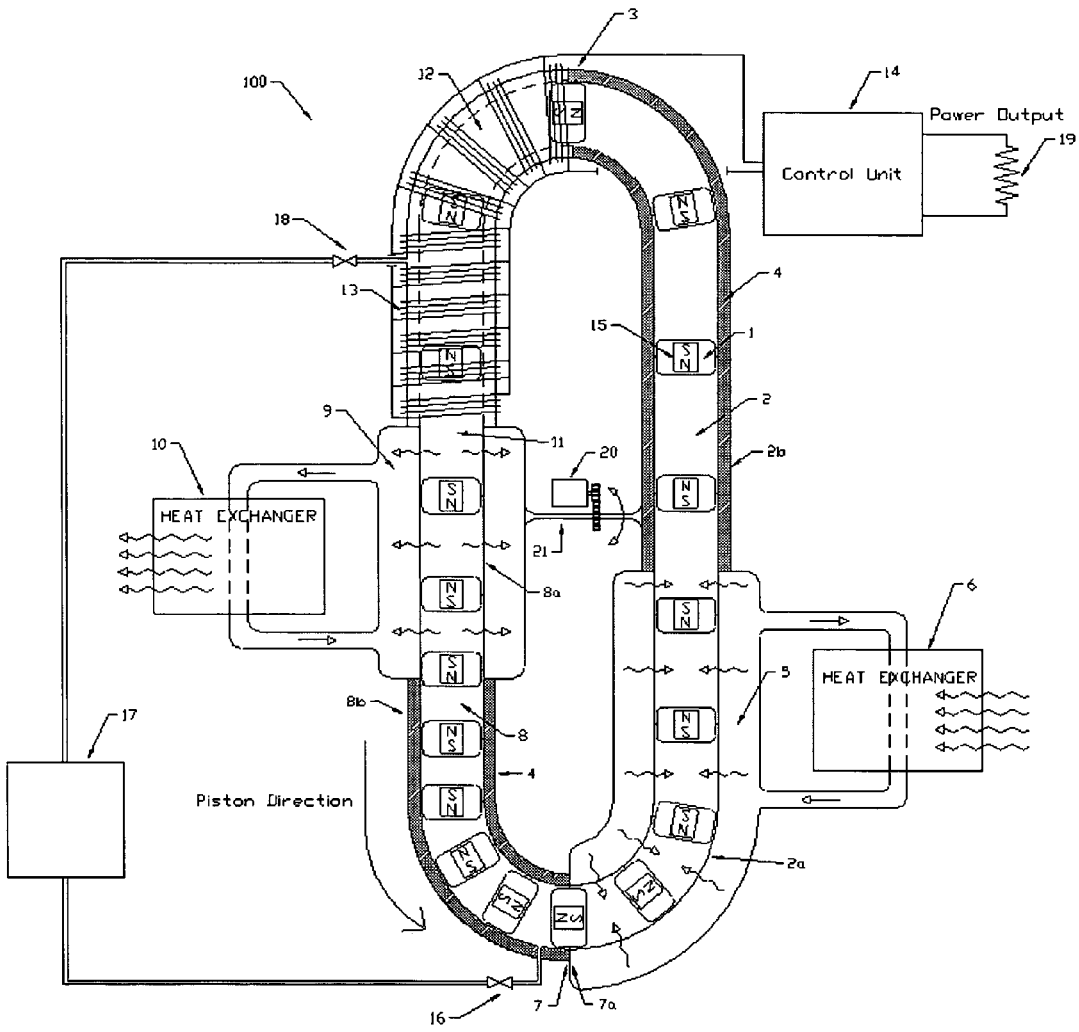

FIGURE 2 CARNOT CYCLE REFRIGERATOR WITH ELECTRICAL WORK INPUT
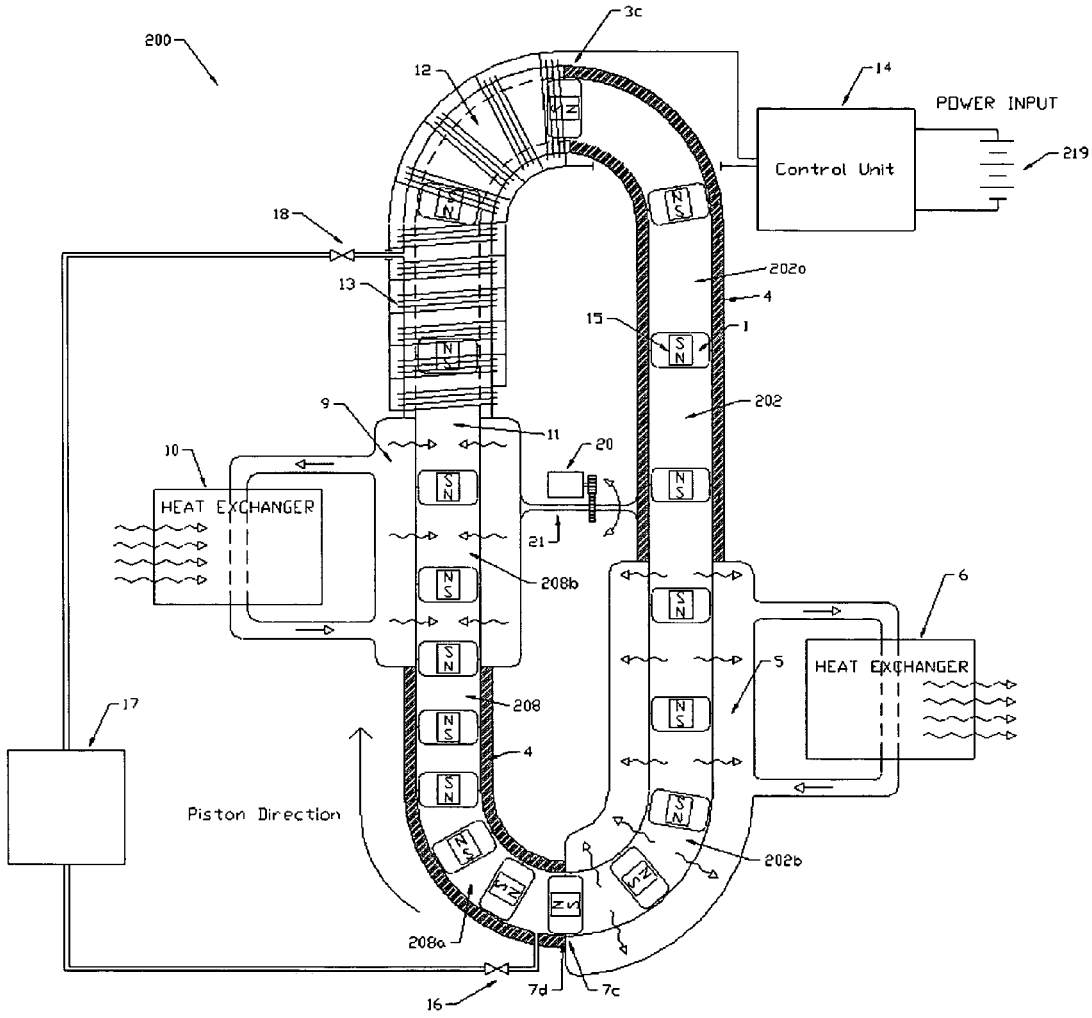

FIGURE 3 CARNOT CYCLE ENGINE WITH MECHANICAL WORK OUTPUT
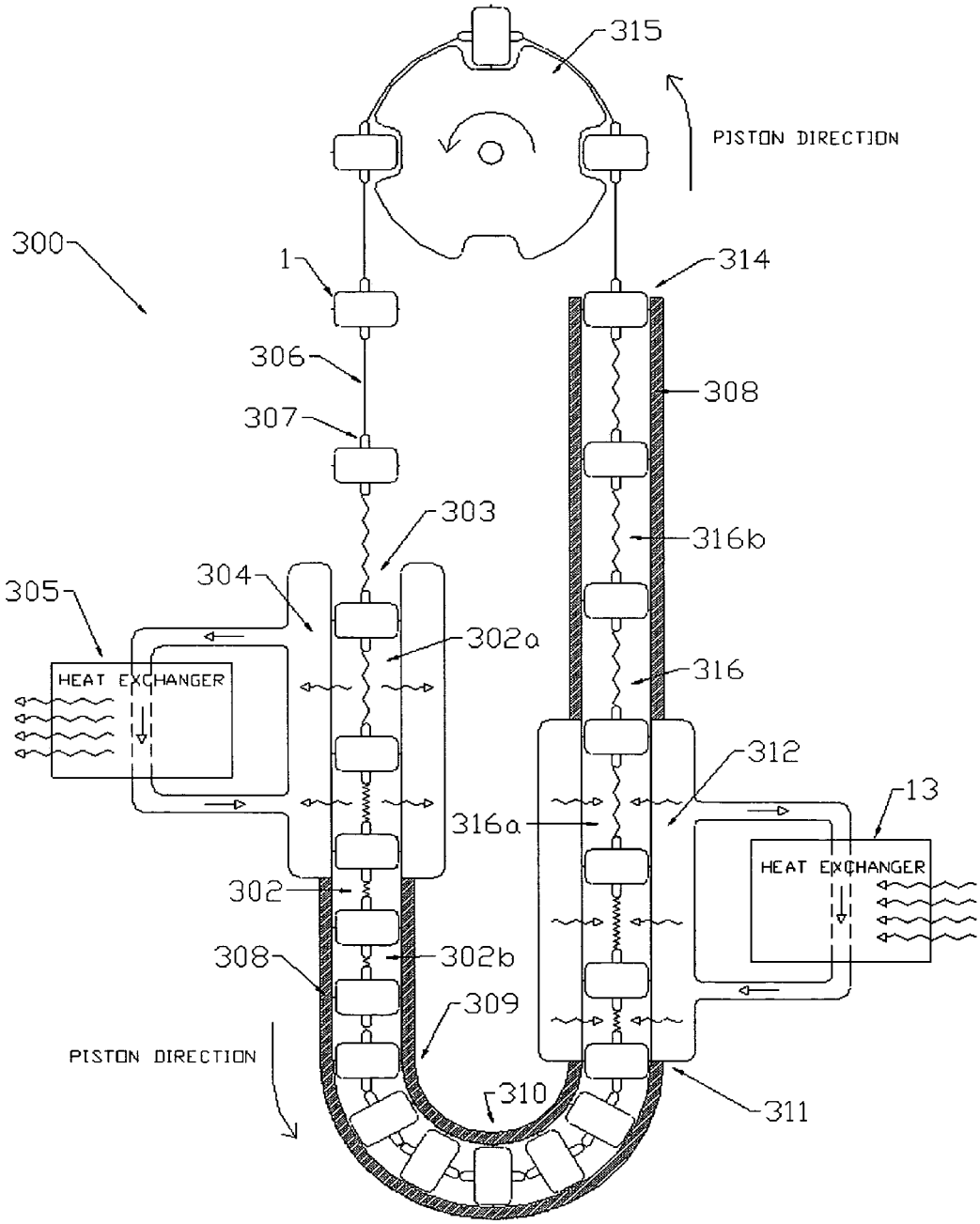

FIGURE 4 CARNOT CYCLE REFRIGERATOR WITH MECHANICAL WORK INPUT
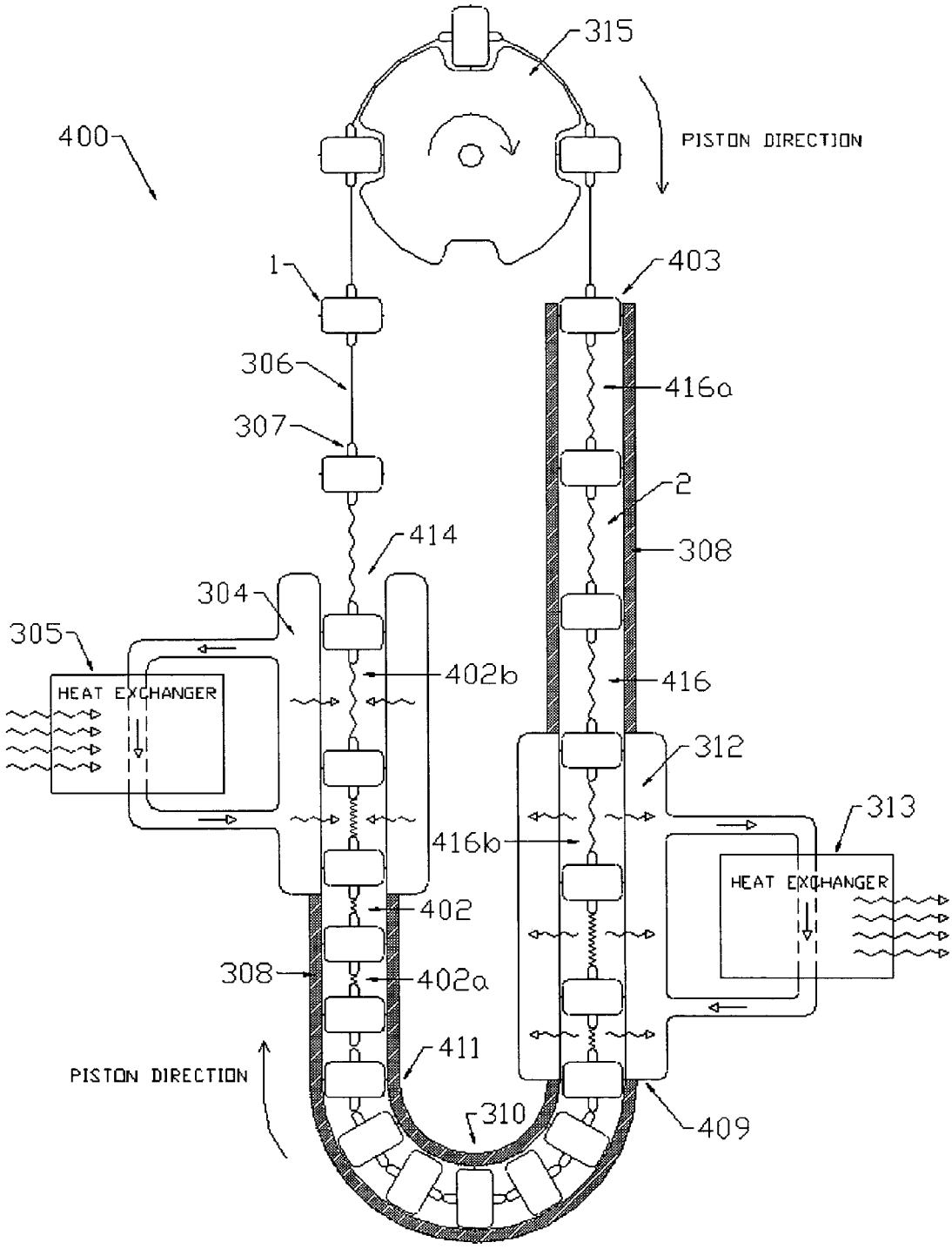

FIGURE 5 HINGED PISTON
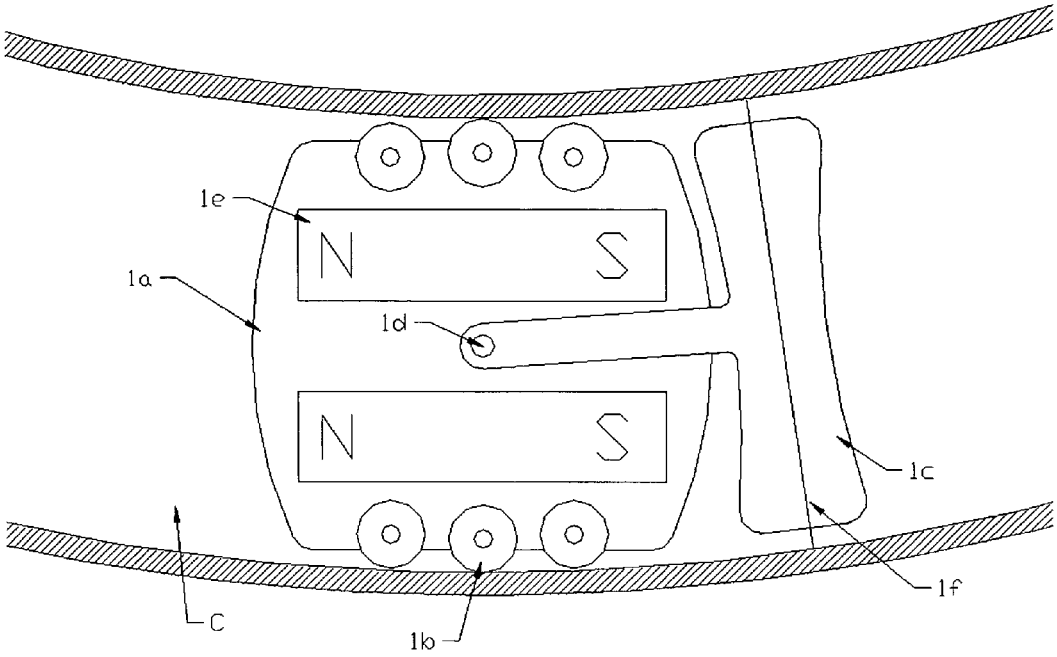

REVERSIBLE HEAT ENGINE

TECHNICAL FIELD

The present invention relates generally to heat engines, and more specifically to a reversible heat engine of the piston-cylinder type. The present invention can be operated as either a forward heat engine, producing a power output if a high temperature heat source is provided, or, alternatively, as a reverse heat engine (e.g. a refrigerator or heat pump) if a power input is provided.

BACKGROUND OF THE INVENTION

A forward heat engine is a device that converts thermal energy (heat) into mechanical work. A reverse heat engine is a device that utilizes a mechanical work input to transfer heat from a body at a low temperature to a body at a higher temperature. Countless varieties of both forward and reverse heat engines have been created. Examples of common forward heat engines include the internal combustion engine, gas turbine engines, steam turbine engines and Stirling engines. Examples of reverse heat engines include common air conditioners, refrigerators and heat pumps.

Still other engines have been constructed to permit operation of same as either a forward heat engine or a reverse heat engine at any given selected moment. External heat engines that follow the Stirling or Carnot cycles are good examples of such engines.

For either a reverse heat engine or for a forward heat engine, the engine could be configured to follow the highly efficient Carnot cycle. The efficiencies of both the forward and reverse Carnot cycles are equal to the maximum values possible according to the second law of thermodynamics for a heat engine operating between two given temperatures. Thus it is highly desirable to construct a practical heat engine that is capable of following the Carnot cycle.

The present invention represents an alternative to existing reverse heat engines, such as air conditioners and heat pumps that follow inefficient vapor compression cycles, and further represents an alternative to existing forward heat engines. Specifically, the present invention provides a heat engine that can be configured to operate as either a forward or a reverse heat engine, yet does not need to follow any particular thermodynamic cycle. By making strategic changes to the engine such as the locations of the heat exchangers and the shape of the cylinders, the working fluid of the engine could be cycled through a large variety of different thermodynamic processes.

BRIEF SUMMARY OF THE INVENTION

Briefly described, in a preferred embodiment, the present invention overcomes the above-mentioned disadvantages and meets the recognized need for such a device by providing a heat engine capable of higher thermal efficiencies than existing heat engines operating within the same temperature ranges, wherein the heat engine can operate efficiently as either a forward heat engine or a reverse heat engine at any given selected moment. As such, the present heat engine can be utilized as an air conditioner or heat pump, or, alternatively, if a heat source is provided to the engine, as a forward heat engine producing a power output.

For operation as a forward heat engine, a suitable source of heat could be an environmentally friendly heat source such as a solar water heater. Solar water heaters sit idle most of the day because most hot water use occurs in the morning or at night. The present heat engine could utilize this thermal energy that would otherwise be wasted, and convert it to electricity.

According to its major aspects and broadly stated, the present invention in its preferred form is a heat engine having a working fluid (such as air or helium), a plurality of double sided pistons, a compression cylinder, an expansion cylinder, a means to add heat to the working fluid, a means to remove heat from the working fluid, a force (such as gravity) to force the pistons through the compression cylinder, and a force (such as gravity) to oppose, but not stop, the motion of the pistons through the expansion cylinder.

More specifically, the present invention is a heat engine, wherein the pistons of the engine move in a continuous direction, unlike traditional piston-cylinder engines where the pistons move in a reciprocating motion. The pistons and the working fluid enter the compression cylinder at the low-pressure side and leave the cylinder at the high-pressure side. The pistons are forced closer together as they move through the cylinder which reduces the volume of the working fluid between the pistons and thus compresses the fluid. The pistons and the compressed working fluid then enter the expansion cylinder at the high-pressure side and leave the cylinder at the low-pressure side. Expansion of the working fluid occurs as the pistons move apart and travel through the expansion cylinder. The compression and expansion cylinders can be connected in a continuous fashion or, alternatively, could be configured as separate cylinders connected by passageways to transfer the pistons and working fluid therebetween.

Additionally, since the pistons of the invention are not connected to connecting rods and a crankshaft, a different means must be utilized to provide the work input necessary to force the pistons closer together during the compression cycle and to harness the work performed on the pistons by the expanding fluid during the expansion cycle.

As such, in a preferred embodiment of the invention, the force of gravity is utilized to force the pistons closer together as the pistons move through the compression cylinder, and to resist the pistons moving apart as the pistons move through the expansion cylinder. In this embodiment the cylinders are preferably arranged in a vertical or other non-horizontal orientation. The pistons and working fluid enter the compression cylinder at the top of the cylinder and are pulled down by gravity to the bottom. The weight of the pistons increase the pressure exerted on working fluid beneath the pistons. If the compression cylinder was straight and oriented vertically, the pressure that a piston in that cylinder would exert on the fluid beneath it would be equal to the weight of the piston divided by the cross-sectional area of the cylinder plus the pressure exerted on piston by the working fluid above the piston.

The pressure exerted on the working fluid in the cylinder increases as the working fluid and the pistons around it move downward through the cylinder, and as more pistons enter the cylinder on top of the working fluid. In a straight cylinder oriented vertically, the pressure exerted on the working fluid would be equal to the weight of all the pistons on top of the working fluid divided by the cross-sectional area of the cylinder plus the starting pressure of the working fluid.

Once the pistons and working fluid leave the compression cylinder, the pistons enter the high-pressure side of the expansion cylinder at the bottom of the cylinder. As the pistons move upward through the expansion cylinder, the pistons above them leave the cylinder and the total weight of the pistons above them decreases. As the weight of the pistons above the working fluid decreases, the total pressure exerted on the fluid decreases and the fluid expands pushing the pistons further apart.

During the compression phase of the engine cycle, the gravitational potential energy of the pistons is converted to mechanical energy forcing the pistons closer together and compressing the fluid. The mechanical energy is converted to thermal energy as the working fluid heats up during the compression process. The work done by each piston on the fluid beneath each piston to compress the fluid is equal to the weight of the piston multiplied by the vertical distance the piston drops.

As the pistons and working fluid move upward through the expansion cylinder the opposite occurs. The pressure exerted on the fluid decreases and the fluid expands forcing the pistons further apart. This expansion causes the fluid to cool, thus its thermal energy is converted back into mechanical work which forces the pistons upward, increasing the gravitational potential energy of same. The work done by the expanding fluid on the piston above the fluid is equal to the weight of the piston multiplied by the vertical distance the piston raises.

If no heat is added or removed from the working fluid during compression and expansion cycles, the work done by the expanding fluid on the pistons would be equal to the work done by the pistons on the fluid to compress same. Thus the pistons could leave the expansion cylinder at the same height that the pistons entered the compression cylinder and no net work would be produced by the engine. Additionally the working fluid would leave the expansion cylinder at the same temperature that it was when it entered the compression cylinder. If heat is added or removed from the working fluid during these processes however, the net amount of work produced by the cycle could be altered.

For example, if the working fluid is heated during the expansion process it will expand further doing more work on the pistons and pushing them upward to a higher elevation. Likewise, if the working fluid is cooled during the compression process, the density of the fluid would increase and the amount of work required to compress the fluid would decrease. Thus, the pistons would not need to fall as far of a distance to compress the fluid.

For a heat engine to operate as a forward heat engine and produce a positive amount of work, heat must be added to the working fluid while the working fluid is at a high temperature, and removed from the working fluid while the working fluid is at a low temperature.

For a heat engine to operate as a reverse heat engine, heat must be added to the working fluid while the working fluid is at a low temperature, and rejected from the working fluid while the working fluid is at a high temperature. A work input is necessary for reverse heat engines because heat does not flow naturally from a body at a low temperature to a body at a higher temperature.

For the engine to follow the forward Carnot cycle, it must cycle the working gas through the following four processes: isothermal compression, adiabatic compression, isothermal expansion, and adiabatic expansion. A preferred embodiment of the present invention follows the Carnot cycle.

Isothermal compression occurs in the top section of the compression cylinder. It is achieved by circulating a heat transfer fluid such as water around the outside wall of cylinder. This allows the heat generated in the working fluid by the compression process to be absorbed by the heat transfer fluid through the walls of the cylinder so that the temperature of the working fluid remains constant during the compression process. The cooling fluid then rejects the heat it absorbed from the working fluid to an external body through a heat exchanger.

The adiabatic compression phase of the cycle occurs in the bottom section of the compression cylinder. The bottom section of the cylinder is insulated from its surroundings so that all of the heat generated by the compression process remains in the working fluid and the working fluid heats up to its maximum operating temperature when it reaches the end of the compression cylinder.

Isothermal expansion occurs in the bottom section of the expansion cylinder. It is accomplished by utilizing a heat source (such as a solar water heater) to heat a heat transfer fluid that is circulated around the outside wall of the cylinder. As the working fluid moves upward through the cylinder and expands, the working fluid absorbs heat from the heating fluid through the walls of the cylinder but remains at a constant temperature because of the expansion process.

The adiabatic expansion phase of the cycle occurs in the top section of the expansion cylinder. The top section of the cylinder is insulated from its surroundings so no heat is lost from the working fluid to its surroundings. As the working fluid moves upward through this section of the expansion cylinder, the working fluid expands and cools as it pushes the pistons upward and out of the cylinder.

In the foregoing arrangement, the engine pistons leave the expansion cylinder at a higher elevation than when they enter the compression cylinder. An apparatus can then be utilized to convert the gravitational potential energy of the pistons to a mechanical or electrical work output as they fall from the exit point of the expansion cylinder to the entry point of the compression cylinder.

The preferred embodiment of the present heat engine could also follow the reverse Carnot cycle. The only difference would be that the direction that the pistons move would be reversed and the direction of heat flow through the heat exchangers would also be reversed. Additionally, in such an arrangement, the cylinder that functioned as the compression cylinder for the forward heat engine would function as the expansion cylinder for the reverse heat engine. Likewise the cylinder that functioned as the expansion cylinder for the forward heat engine would function as the compression cylinder for the reverse heat engine.

For the engine to follow the reverse Carnot cycle it must cycle the working gas through the following four processes: adiabatic compression, isothermal compression, adiabatic expansion, and isothermal expansion.

In this preferred embodiment operating as a reverse heat engine, the adiabatic compression phase of the cycle occurs in the top section of the compression cylinder. The top section of the cylinder is insulated from its surroundings so that all of the heat generated by the compression process remains in the working fluid and the working fluid heats up to its maximum operating temperature when it reaches the end of the top section of the compression cylinder.

Isothermal compression occurs in the bottom section of the compression cylinder. It is achieved by circulating a heat transfer fluid around the outside wall of the cylinder. This allows the heat generated in the working fluid by the compression process to be absorbed by the cooling fluid through the walls of the cylinder so that the temperature of the working fluid remains constant. The cooling fluid then rejects the heat it absorbed from the working fluid to an external body through a heat exchanger.

The adiabatic expansion phase of the cycle occurs in the bottom section of the expansion cylinder. The bottom section of the cylinder is insulated from its surroundings so that no heat is exchanged between the working fluid and its surroundings. As the working fluid moves upward through the bottom section of the expansion cylinder it expands and cools as it pushes the pistons upward through the cylinder.

Isothermal expansion occurs in the top section of the expansion cylinder. It is accomplished circulated a heat transfer fluid around the cylinder. As the working fluid moves upward through the cylinder and expands, the working fluid absorbs heat from the heating fluid through the walls of the cylinder but remains at a constant temperature because of the expansion process.

In the foregoing arrangement, the pistons leave the expansion cylinder at a lower elevation than they enter the compression cylinder, thus an apparatus is required to lift the pistons from the exit point of the expansion cylinder to entry point of the compression cylinder.

If electricity is powering the lifting apparatus of a reverse heat engine embodiment, a regular electric motor could be utilized to turn a wheel, a conveyor belt or something similar that would lift the pistons upward. Alternatively, the components of a linear motor could be integrated with the engine components. This could reduce the total number of parts required and the complexity of the engine. Likewise, if the purpose of the forward heat engine embodiment described above is to generate electricity, the components of a linear generator could be integrated with the engine components.

Although, linear motors and linear generators can be constructed in a huge variety of different ways, they all rely on the same basic principles. Additionally, electrical motors and electrical generators are essentially the same thing and a single device can operate as either a motor or a generator.

A method utilized to incorporate a linear motor/generator into a preferred embodiment of the present invention utilizes permanent magnets in the engine pistons and coils of wire wrapped around the passageway between the expansion cylinder and the compression cylinder. Running an electrical current through a coil of wire turns the coil into a solenoid. A solenoid is an electromagnetic created from a coil wire wrapped around a hollow cylinder. When an electrical current is run through the wire, a magnetic field is created in and around the coil. The shape of the magnetic field is similar to that of a bar magnet with one side of the coil being the north pole of the magnet and the opposite side being the south pole. The orientation of the poles of the solenoid is determined by the direction of the current in the wire. If a magnet is placed near the edge of the solenoid, the magnet will either be attracted to the center of the solenoid or repelled from it depending on the orientation of the magnetic poles. Opposite poles of a magnet attract each other while like poles repel. By turning the solenoids on and off in the proper sequence to create attractive and/or repulsive forces, the pistons can be propelled in the desired direction through a passageway or a cylinder.

A linear generator for use in the forward heat engine embodiment can also be constructed using the same components. If a magnet is forced through a coil of wire, an electrical current will be induced in the wire. If the magnet moves completely through the coil, the current it induces in the coil will be an alternating current. The current will travel in one direction when the magnet moves from one side of the coil to the center of the coil and in the other direction as the magnet moves from the center of the coil to the opposite side of the coil. If the speed of the pistons and distance between them were precisely controlled at a consistent 60 Hrz, alternating current could be produced that could be utilized to power an external load. Alternatively, diodes could be placed in series with the coils allowing current to travel through the coils in only one direction. This would create a pulsed direct current that could later be converted to alternating current if desired. The induced current in the coils also has the unavoidable effect of creating a magnetic field that opposes the motion of the magnet through the coil.

Accordingly, a feature and advantage of the present invention is its ability to function as either a forward heat engine producing a work output or a reverse heat engine (e.g., an air conditioner, refrigerator, or heat pump) at any given selected moment.

Another feature and advantage of the present invention is its ability to yield significantly higher thermal efficiencies than existing heat engines operating within the same temperature ranges.

These and other features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which:

FIG. 1 is a schematic illustration of the present heat engine operating as a forward heat engine showing electrical work output;

FIG. 2 is a schematic illustration of the present heat engine operating as a reverse heat engine powered by an electrical work input;

FIG. 3 is a schematic illustration of the present heat engine operating as a forward heat engine showing mechanical work output;

FIG. 4 is a schematic illustration of the present heat engine operating as a reverse heat engine showing mechanical work input; and, FIG. 5 is a schematic illustration of a preferred embodiment of a hinged piston of the present heat engine utilized by the embodiment illustrated in FIGS. 1–2.

DETAILED DESCRIPTION OF THE PREFERRED AND ALTERNATIVE EMBODIMENTS

In describing the preferred and alternate embodiments of the present invention, as illustrated in FIGS. 1–5, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIG. 1, illustrated therein is heat engine 100, wherein the engine pistons 1 enter the compression cylinder 8 at the entry point 11 of the cylinder 8. A working fluid such as air occupies the space between the pistons 1 within the cylinder 8. Gravity pulls the pistons 1 and the working fluid between pistons 1 downward through the cylinder 8 compressing the working fluid.

A heat transfer fluid 9 is circulated around the outside wall of the top section of the compression cylinder 8*a*. Heat generated by the compression process is absorbed by the heat transfer fluid 9. The heat transfer fluid 9 is then circulated through a heat exchanger 10 that rejects heat from the fluid 9 to an external body such as the atmosphere.

The bottom section 8*b* of the cylinder 8 is covered with a layer of insulation 4 to prevent heat transfer between the working fluid and its surroundings.

The engine pistons 1 then leave the compression cylinder 8 at the exit point 7 of the cylinder 8 and enter the expansion cylinder 2 at the entry point 7*a* of the expansion cylinder 2. The pistons 1 move upward though the expansion cylinder 2.

A heat transfer fluid 5 is circulated around the bottom section 2*a* of the expansion cylinder 2. Heat is absorbed by the working fluid from the heat transfer fluid 5 through the walls of the cylinder 2. The heat transfer fluid 5 is then circulated through a heat exchanger 6 where heat is absorbed from the heat source that is powering the engine 100. The top section 2*b* of the expansion cylinder 2 is covered with a layer of insulation 4.

The pistons 1 and working fluid leave the expansion cylinder 2 at the exit point 3 of the cylinder 2 and enter a passageway 12 connecting the two cylinders 2 and 8. Permanent magnets 15 within the pistons 1 induce an electrical current in coils of wire 13 wrapped around the passageway 12 as the pistons 1 fall from the exit point 3 of the expansion cylinder 2 to the entry point 11 of the compression cylinder 8. A control unit 14 turns the electricity generated by the coils of wire 13 into the desired direct or alternating current and supplies the current to an external load 19.

A valve means 16 can be opened to allow compressed working fluid to leave the engine 100 and be stored in the fluid reservoir 17. This decreases the amount of working fluid in the engine 100 and increases the pressure ratio of the engine 100. A valve means 18 can be opened to allow compressed working fluid from the fluid reservoir 17 to enter the engine 100. This increases the amount of working fluid in the engine 100 and decreases the pressure ratio of the engine 100.

A motor and gear assembly 20 can also be utilized to rotate the engine 100 about its horizontal axis 21 and alter the pressure ratio of the engine.

Referring now to FIG. 2, the reverse heat engine 200 illustrated therein is identical to the forward engine 100 illustrated in FIG. 1 with a few minor exceptions. The pistons 1 travel in the opposite direction which makes the compression cylinder 8 of the forward heat engine 100 the expansion cylinder 208 of the reverse heat engine 200, and the expansion cylinder 2 of the forward heat engine 100 the compression cylinder 202 of the reverse heat engine 200. Additionally, the direction of heat flow through the heat exchangers 6 and 10 is reversed and the linear generator of the forward heat engine 100 functions as a linear motor in the reverse heat engine 200.

The engine pistons 1 enter the compression cylinder 202 at the entry point 3*c* of the cylinder 202. A working fluid such as air occupies the space between the pistons 1 within the cylinder 202. Gravity pulls the pistons 1 and the working fluid between them downward through the cylinder 202 compressing the working fluid. The top section 202*a* of the cylinder 202 is covered with a layer of insulation 4 to prevent heat transfer between the working fluid and its surroundings.

A heat transfer fluid 5 is circulated around the outside wall of the bottom section 202*b* of the compression cylinder 202. Heat generated by the compression process is absorbed by the heat transfer fluid 5. The heat transfer fluid 5 is then circulated through a heat exchanger 6 which rejects heat from the fluid to an external body such as the atmosphere. The engine pistons 1 then leave the compression cylinder 202 at the exit point 7*c* of the cylinder 202 and enter the expansion cylinder 208 at the entry, point 7*d* of the expansion cylinder 208. The pistons 1 move upward though the expansion cylinder 208.

The bottom section 208*a* of the expansion cylinder 208 is covered with a layer of insulation 4. A heat transfer fluid 9 is circulated around the top section 208*b* of the expansion cylinder. Heat is absorbed by the working fluid from the heat transfer fluid 9 through the walls of the cylinder 208. The heat transfer fluid 9 is then circulated through a heat exchanger 10 where heat is absorbed from the body that the refrigerator is cooling, such as an interior of a house.

The pistons 1 and working fluid leave the expansion cylinder 208 at the exit point 11*a* of the cylinder 208 and enter a passageway 12 connecting the two cylinders 208 and 202. A control unit 14 sends an electrical current through coils of wire 13 surrounding the passageway creating magnetic fields that exert forces on the permanent magnets 15 within the pistons 1 pushing and/or pulling the pistons 1 through the passageway 12. An electrical power source 219 provides power to the control unit 14.

A valve means 16 can be opened to allow compressed working fluid to leave the engine 200 and be stored in the fluid reservoir 17. This decreases the amount of working fluid in the engine 200 and increases the pressure ratio of the engine 200. A valve means 18 can be opened to allow compressed working fluid from the fluid reservoir 17 to enter the engine 200. This increases the amount of working fluid in the engine 200 and decreases the pressure ratio of the engine.

A motor and gear assembly 20 can also be used to rotate the engine 200 about its horizontal axis 21 and alter the pressure ratio of the engine 200.

Referring now to FIG. 3, the forward heat engine 300 illustrated in FIG. 3 is similar to the forward engine 100 illustrated in FIG. 1 except that it produces a mechanical work output rather than an electrical work output. The engine pistons 1 enter the compression cylinder 302 at the entry point 303 of the cylinder 302. A mechanical linkage 306 prevents the pistons 1 from moving more than a desired distance apart. A mechanical spacer 307 prevents the pistons 1 from getting to close to each other.

A working fluid occupies the space between the pistons 1 within the cylinder 302. Gravity pulls the pistons 1, and the working fluid between the pistons 1, downward through the cylinder 302 compressing the working fluid.

A heat transfer fluid 304 such as water is circulated around the outside wall of the top section 302*a* of the compression cylinder 302. Heat generated by the compression process is absorbed by the heat transfer fluid 304. The heat transfer fluid 304 is then circulated through a heat exchanger 305 which rejects heat from the fluid 304 to an external body.

The bottom section 302*b* of the cylinder 302 is covered with a layer of insulation 308 to prevent heat transfer between the working fluid and its surroundings. The mechanical spacers 307 on the pistons 1 touch at the exit point 309 of the cylinder 302, preventing the working fluid between them from being compressed any further. The pistons 1 then travel through a passageway 310 connecting the high pressure side of the compression cylinder 302 to the high pressure side of the expansion cylinder 316. The pistons 1 and working fluid enter the expansion cylinder 316 at the entry point 311 of the cylinder 316.

A heat transfer fluid 312 is circulated around the bottom section 316*a* of the expansion cylinder 316. Heat is absorbed by the working fluid from the heat transfer fluid 312 through the walls of the cylinder 316. The heat transfer fluid 312 is then circulated through a heat exchanger 313 where heat is absorbed from the heat source that is powering the engine 300. The top section 316*b* of the expansion cylinder 316 is covered with a layer of insulation 308.

As a piston 1 nears the exit point 314 of the expansion cylinder 316 the linkage connecting the pistons 1 to the piston 1 above it becomes taut and pulls the piston 1 out of the cylinder 316. The pistons 1 then rotate over the top of the power transfer wheel 315 and travel back down into the compression cylinder 302. Because the entry point 303 of the compression cylinder 302 is at a lower elevation than the exit point 314 of the expansion cylinder 316 more weight is being supported by one side of the power transfer wheel 315 and the wheel 315 is forced to rotate counterclockwise producing a rotational work output.

Referring now to FIG. 4, the reverse heat engine 400 illustrated therein identical to the forward engine 300 illustrated in FIG. 3 with a few minor exceptions. The pistons 1 travel in the opposite direction which makes the compression cylinder 302 of the forward heat engine 300 the expansion cylinder 402 of the reverse heat engine 400, and the expansion cylinder 316 of the forward heat engine 300 the compression cylinder 416. Additionally, the direction of heat flow through the heat exchangers 305 and 313 is reversed and the engine 400 requires a rotational work input.

The engine pistons 1 enter the compression cylinder 416 at the entry point 403 of the cylinder 416. A mechanical linkage 306 prevents the pistons 1 from moving more than a desired distance apart. A mechanical spacer 307 prevents the pistons 1 from getting to close to each other.

A working fluid occupies the space between the pistons 1 within the cylinder 416. Gravity pulls the pistons 1 and the working fluid between them downward through the cylinder 416 compressing the working fluid.

The top section 416*a* of the cylinder 416 is covered with a layer of insulation 308 to prevent heat transfer between the working fluid and its surroundings.

A heat transfer fluid 312 such as water is circulated around the outside wall of the bottom section 416*b* of the compression cylinder 416. Heat generated by the compression process is absorbed by the heat transfer fluid 304. The heat transfer fluid 312 is then circulated through a heat exchanger 313 which rejects heat from the fluid to an external body.

The mechanical spacers 307 on the pistons 1 touch at the exit point 409 of the compression cylinder 416 preventing the working fluid between them from being compressed any further. The pistons then travel through a passageway 310 connecting the high pressure side of the compression cylinder 416 to the high pressure side of the expansion cylinder 402. The pistons 1 and working fluid enter the expansion cylinder 402 at the entry point 411 of the cylinder 402.

The bottom section 402*a* of the expansion cylinder 402 is covered with a layer of insulation 308. A heat transfer fluid 304 is circulated around the top section 402*b* of the expansion cylinder 402. Heat is absorbed by the working fluid from the heat transfer fluid 304 through the walls of the cylinder 402. The heat transfer fluid 304 is then circulated through a heat exchanger 305 where heat is absorbed from the body that the refrigerator is cooling.

As a piston 1 nears the exit point 414 of the expansion cylinder 402 the linkage 306 connecting the piston 1 to the pistons 1 above it becomes taut and pulls the piston 1 out of the cylinder 402. The pistons 1 then rotate over the top of the power transfer wheel 315 and travel back down into the compression cylinder 416. Because the entry point 403 of the compression cylinder 416 is at a higher elevation than the exit point 414 of the expansion cylinder 402 more weight is being supported by one side of the power transfer wheel and a work input is required to rotate the wheel 315 clockwise and power the engine.

Referring now to FIG. 5, illustrated therein is a preferred embodiment of an engine piston 1 utilized by the embodiment illustrated in FIG. 1-2. The piston 1 is broken into two segments which move relative to each other to conform to the shape of the cylinder C. The weight of the main piston body 1*a* is supported by wheels 1*b* to reduce friction as the piston 1 moves through the cylinder C. The face 1*c* of the piston 1 pivots around a hinge 1*d*. One or more magnets 1*e* are built into the piston body 1*a*. A piston ring 1*f* prevents working fluid from leaking around the face 1*c* of the piston 1.

In use, reverse heat engines are the most efficient when the difference between the temperature that heat is added to the working fluid and the temperature that heat is removed from the working fluid is as small as possible. Conversely, forward head engines are the most efficient when the difference between the temperature that heat is added to the working fluid and the temperature that heat is removed from the working fluid is as large as possible.

AS such, the several embodiments of the present invention should be constructed to cycle the working fluid through a large temperature range if it is to be utilized only as a forward heat engine, and should be constructed to cycle the working fluid through a small temperature range if it is to be utilized only as a reverse heat engine. Alternatively, the present inventive engine could be constructed in such a way that the operational parameters of the engine could be altered during operation so that it could work efficiently as either a forward or a reverse heat engine.

The temperature range of working fluid can be altered by altering the pressure ratio (the maximum pressure of the working fluid divided be the minimum pressure) of the engine. Increasing the pressure ratio of the engine will increase the temperature range of the working fluid, because the more the working fluid is compressed adiabatically, the hotter it will get. Likewise the more the working fluid expands adiabatically, the cooler it will get.

Factors that affect the pressure ratio of an engine include the weight of the pistons, the number of pistons in each cylinder, the degree of inclination of the cylinders, and the starting pressure of the engine. Increasing the weight of the pistons increases the pressure that each piston exerts on the working fluid beneath it. So increasing the weight of the pistons would increase the pressure ratio of the engine and vise versa. Also changing the angle of inclination of the cylinders would change the pressure ratio of the engine. If the engine cylinders are not oriented vertically, part of the weight of each piston would be supported by the walls of the cylinder. This would reduce the pressure that each the pistons exert on the working fluid. Thus increasing the angle of inclination will increase the pressure ratio of the engine and decreasing the angle of inclination will decrease it.

Changing the pressure that the working fluid is in when it enters the compression cylinder (the starting pressure of the engine) will also affect the pressure ratio. For example, if each piston in a cylinder exerted 2 psi of pressure on the working fluid beneath it and there were 7 pistons in each cylinder and the starting pressure of the engine was atmospheric pressure (roughly 14 psi); the pressure of the working gas would increase from 14 psi to 28 psi. The pressure ratio of the engine would be 2. If however the starting pressure of the engine was decreased to 7 psi the ending pressure would be 21 psi and the pressure ratio would be 3.

An auxiliary compressor could be utilized to increase or decrease the starting pressure of the engine. Alternatively, the engine could take advantage of its existing compression capability. The embodiments illustrated in FIGS. 1–2 utilize this capability. Removing small amounts of compressed working fluid from the engine while it is in operation through a hole in the compression cylinder and storing that fluid in a reservoir would decrease the total amount of working fluid in the engine, and thus, increase the pressure ratio of the engine. Likewise, allowing the compressed fluid from the reservoir into the engine through a valve means would increase the total amount of working fluid in the engine, and thus, decrease the pressure ratio. The reservoir could be a tank capable of storing compressed fluid or if the working fluid was air the reservoir could simply be the atmosphere.

The type of working fluid utilized will also affect the performance of the engine. Using air as the working fluid has several advantages. Air is free and would make the engine easy to maintain. Additionally, an engine using air could also operate on an open cycle. Helium also has several properties that make it ideal for utilization in a heat engine. It has a lower specific heat than air which can improve the efficiency of a heat engine. Helium is also a much better heat conductor than air.

Controlling the distance between the pistons as the pistons move throughout the engine can also affect the performance of the engine. Several different means could be applied to keep the pistons the desired distance apart. The pistons could be connected by a mechanical linkage such as a cable to prevent the pistons from moving to far apart. The pistons could also have mechanical spacers to prevent them from getting to close to each other. The embodiment illustrated in FIGS. 3–4 utilize these methods.

Additionally, for freely moving pistons in the passage ways between the cylinders, mechanical, electromagnetic or gravitational forces could be utilized to alter the spacing between the pistons.

The cross-sectional shape of the cylinders and pistons could also affect the performance of the engine, as the preferred embodiments utilize the walls of the cylinders to transfer heat to and from the working fluid. Making the surface area of the cylinders larger will improve the engines ability to transfer heat to and from the working fluid. Utilizing rectangular or oval-shaped cylinders and pistons would increase the surface area of a cylinder for a given volume of working fluid.

It is contemplated in an alternate embodiment that the basic components of the present heat engine and the several embodiment of same described herein can be configured in a variety of different ways to specialize the engine for different purposes.

An alternative embodiment that does not rely on the force of gravity could be constructed by incorporating both the linear motor and linear generator described above into the engine. In such an embodiment a linear motor could be incorporated with the compression cylinder that forces the pistons through the compression cylinder, wherein a linear generator could be incorporated with the expansion cylinder to convert the work created by the expanding gas into electrical energy as the pistons move through the expansion cylinder. If such an embodiment were configured as a forward heat engine, more electricity will be generated by the linear generator than would consumed by the linear motor and the excess electricity could be used to power an external load. Unfortunately, however, linear motors and generators are not one-hundred percent efficient, so this embodiment would not likely be as efficient as an embodiment that relied on gravity.

All of the embodiments of the present heat engine described thus far have also utilized the walls of the cylinder to transfer heat between the working gas and an external fluid. However it would be possible to construct an embodiment that heats or cools the working fluid directly in a heat exchanger. Moving the pistons closer together while the pistons are in a passageway between the cylinders would displace the working fluid between the pistons. Likewise, moving the pistons further apart would draw fluid into the space between the pistons. Such methods could be utilized to redirect the working fluid out of the space between the pistons and through a heat exchanger and then back into the space between the pistons.

Another embodiment operating as a forward heat engine on an open cycle using air as the working fluid could also add heat to the working fluid by combusting a fuel directly in the air. Such a method would also eliminate the need for the working fluid to absorb heat through the walls of the cylinder.

All of the embodiments of the engine discussed thus far have also utilized a working fluid that remains in a gaseous state throughout the cycle of the engine. However, it would be possible for the engine to use a working fluid, such as a refrigerant, that changes state from a gas to a liquid and then back to a gas at different points throughout the engine cycle. Using such a working fluid could be advantageous for reverse heat engine embodiments, and especially for reverse heat engine embodiments that use the method of redirecting the working fluid through a heat exchanger, as described above. Constructing the engine in such a fashion would make the engine work similar to existing refrigerators that utilize vapor compression cycles; however, the inefficient throttling valves utilized by such refrigerators would be replaced by a much more efficient expander.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A heat engine comprising:

a working fluid;

a plurality of movable pistons;

at least one compression cylinder having a plurality of said movable pistons receivable within said at least one compression cylinder defining variable volume fluid chambers between said pistons and having said working fluid occupying a space within said chambers;

at least one expansion cylinder having a plurality of said movable pistons receivable within said at least one expansion cylinder defining variable volume fluid chambers between said pistons and having said working fluid occupying a space within said chambers;

an entry point on one side of said at least one compression cylinder whereby when said engine is in operation, said pistons and said working fluid are at a relatively low pressure state upon entering therein;

an exit point on one side of said at least one compression cylinder opposite the side of said entry point whereby when engine is in operation, said pistons and said working fluid are at a relatively high pressure state upon exiting thereof;

a force acting on said pistons received within said at least one compression cylinder in addition to the forces exerted by said working fluid on said pistons, that propels said pistons through said at least one compression cylinder from said entry point toward said exit point;

an entry point on one side of said at least one expansion cylinder whereby when said engine is in operation, said pistons and said working fluid are at a relatively high pressure state upon entering therein;

an exit point at one side of said at least one expansion cylinder opposite the side of said entry point whereby when engine is in operation, said pistons and said working fluid are at a relatively low pressure state upon exiting thereof;

a force acting on said pistons received within said at least one expansion cylinder in addition to the forces exerted by said working fluid on said pistons that resists the movement of said pistons through said at least one expansion cylinder from said entry point toward said exit point;

a means to add heat to said working fluid;

a means to remove heat from said working fluid; and, a power transfer means to transfer power between said engine and an apparatus.

2. An engine according to claim 1, wherein said entry point of said at least one compression cylinder is at a higher elevation than said exit point of said at least one expansion cylinder, and wherein gravity pulls the pistons within said at least one expansion cylinder downward from said entry point toward said exit point.

3. An engine according to claim 1, wherein said entry point of said at least one expansion cylinder is at a lower elevation than said exit point of said at least one compression cylinder, and wherein gravity resists the movement of said pistons upward from said entry point toward said exit point.

4. An engine according to claim 1, wherein an electromagnetic force is utilized to force said pistons in a desired direction.

5. An engine according to claim 4, wherein at least some of said pistons contain magnets, and wherein a plurality of electromagnets are positioned along at least a partial path of said piston which are turned on and off in a sequence that creates attractive and/or repulsive forces that assist in propelling said pistons in the desired direction.

6. An engine according to claim 1, wherein the movement of said piston creates a relative motion between a magnet and a conductive wire resulting in an induced electrical current in said wire.

7. An engine according to claim 6, wherein at least some of said pistons contain magnets, and wherein conductive wires are positioned along at least a portion of said path of said pistons and said wires have an output for supplying current to a load.

8. An engine according to claim 1, wherein when operating as a forward heat engine producing a net work output, heat is added to said working fluid while said fluid is at a high average temperature and pressure, and heat is removed from said working fluid while said fluid is at a low average temperature and pressure.

9. An engine according to claim 8, wherein said exit point of said at least one expansion cylinder is at a higher elevation than said entry point of said at least one compression cylinder and an apparatus is utilized to convert the gravitational potential energy of said pistons to a rotational work output as said pistons are lowered from said exit point of said at least one expansion cylinder to said entry point of said at least one compression cylinder.

10. An engine according to claim 8, wherein when operating according to an open cycle with air as said working fluid, heat is added to the air by combusting a fuel directly in the air.

11. An engine according to claim 1, utilizing an external work input to operate as a reverse heat engine whereby heat is added to said working fluid while said fluid is at a low average temperature and pressure, and heat is rejected from said working fluid while said fluid is at a high average temperature and pressure.

12. An engine according to claim 11, wherein said exit point of said at least one expansion cylinder is at a lower elevation than said entry point of said at least one compression cylinder and a mechanical lifting apparatus is utilized to raise said engine pistons from said exit point of said at least one expansion cylinder to said entry point of said at least one compression cylinder.

13. An engine according to claim 1, wherein heat is conducted through the walls of said at least one expansion cylinder transferring heat between said working fluid and an external body.

14. An engine according to claim 1, wherein one or both ends of said at least one compression cylinder and at least one expansion cylinder are connected in a continuous fashion.

15. An engine according to claim 1, wherein said at least one compression cylinder and said at least one expansion cylinder are connected via one or more passageways to transfer said pistons and said working fluid between said pistons.

16. An engine according to claim 15, wherein said pistons within said passageway are forced closer together displacing said working fluid between said pistons.

17. An engine according to claim 15, wherein said pistons within said passageway are forced further apart such that working fluid is drawn in to occupy the volume between said pistons.

18. An engine according to claim 1, wherein said pistons are connected by a mechanical linkage which prevents said pistons from moving more than a maximum desired distance apart.

19. An engine according to claim 1, wherein a mechanical spacer prevents the volume between said pistons from decreasing to more than a minimum desired volume.

20. An engine according to claim 1, wherein the shape of the cross section of said cylinders are a noncircular shape.

21. An engine according to claim 20, wherein the shape of the cross section of said pistons are a noncircular shape.

22. An engine according to claim 1, further comprising a means to adjust the degree of inclination of one or more of said engine cylinders.

23. An engine according to claim 1, further comprising a means to adjust the pressure of said working fluid entering said at least one compression cylinder.

24. An engine according to claim 1, further comprising a plurality of holes in the wall of said cylinders and a valve means in fluid-flow communication with said hole to allow the movement of working fluid in or out of said cylinders.

25. An engine according to claim 1, wherein said engine pistons have a roller means to support the lateral force exerted by said pistons on the wall of the respective cylinders.

26. An engine according to claim 1, wherein said engine pistons are broken into segments that move relative to each other to conform the shape of the respective cylinders.

27. A method for a heat engine, comprising the steps of:

a. obtaining a heat engine comprising a working fluid; a plurality of movable pistons; at least one compression cylinder having a plurality of said movable pistons receivable within said at least one compression cylinder defining variable volume fluid chambers between said pistons and having said working fluid occupying a space within said chambers; at least one expansion cylinder having a plurality of said movable pistons receivable within said at least one expansion cylinder defining variable volume fluid chambers between said pistons and having said working fluid occupying a space within said chambers; an entry point on one side of said at least one compression cylinder whereby when said engine is in operation, said pistons and said working fluid are at a relatively low pressure state upon entering therein; an exit point on one side of said at least one compression cylinder opposite the side of said entry point whereby when engine is in operation, said pistons and said working fluid are at a relatively high pressure state upon exiting thereof; a force acting on said pistons received within said at least one compression cylinder in addition to the forces exerted by said working fluid on said pistons, that propels said pistons through said at least one compression cylinder from said entry point toward said exit point; an entry point on one side of said at least one expansion cylinder whereby when said engine is in operation, said pistons and said working fluid are at a relatively high pressure state upon entering therein; an exit point at one side of said at least one expansion cylinder opposite the side of said entry point whereby when engine is in operation, said pistons and said working fluid are at a relatively low pressure state upon exiting thereof; a force acting on said pistons received within said at least one expansion cylinder in addition to the forces exerted by said working fluid on said pistons that resists the movement of said pistons through said at least one expansion cylinder from said entry point toward said exit point; a means to add heat to said working fluid; a means to remove heat from said working fluid; and, a power transfer means to transfer power between said engine and an apparatus; and b. advancing said pistons in a nonhorizontal motion through said at least one compression cylinder and through said at least one expansion cylinder.

* * * * *